United States Patent [19]

Strongwater

[11] Patent Number: 4,847,917

[45] Date of Patent: Jul. 18, 1989

[54] GLOVE CONSTRUCTION WITH MEANS FOR REMOVABLY SECURING ACCESSORIES

[76] Inventor: Murray Strongwater, 326 Hewlett Neck Rd., Woodmere, N.Y. 11598

[21] Appl. No.: 245,744

[22] Filed: Sep. 16, 1988

[51] Int. Cl.[4] ..... A41D 19/00; A41D 27/08

[52] U.S. Cl. ..... 2/160; 2/162; 2/244; 2/265

[58] Field of Search ..... 2/162, 159, 160, 161 R, 2/244, 245, 265, 170; 63/1.1, 2; 24/3 A

[56] References Cited

U.S. PATENT DOCUMENTS

| | | | |
|---|---|---|---|
| 275,780 | 4/1883 | Mahar | 2/160 X |
| 757,730 | 4/1904 | Ferguson | 24/64 |
| 1,217,164 | 2/1917 | Federman | 24/676 |
| 1,358,098 | 11/1920 | Normand | 24/676 |
| 1,491,258 | 4/1924 | Gluckin | 2/68 |
| 1,524,137 | 1/1925 | Kasti et al. | 2/160 |
| 1,711,031 | 4/1929 | Richards | 24/64 |
| 1,838,486 | 12/1931 | Ingraham | 24/64 |
| 1,949,755 | 3/1934 | Mitchell | 2/160 X |
| 2,391,429 | 12/1945 | Lipari | 2/245 |
| 2,748,517 | 6/1956 | Berkis | 40/586 |
| 2,829,416 | 4/1958 | Sam | 24/217 |
| 3,088,295 | 5/1963 | Haines | 63/20 |
| 4,244,057 | 1/1981 | Burnham | 2/170 X |
| 4,519,781 | 5/1985 | Boyd | 2/160 X |
| 4,757,558 | 7/1988 | Strongwater | 2/170 |

FOREIGN PATENT DOCUMENTS

| | | | |
|---|---|---|---|
| 21495 | 2/1899 | United Kingdom | 2/160 |

*Primary Examiner*—Werner H. Schroeder
*Assistant Examiner*—Sara M. Current
*Attorney, Agent, or Firm*—Henry R. Lerner

[57] ABSTRACT

A glove adapted to have releasably secured thereto an ornamental accessory. There is provided fastener means having a pair of complementary fastener portions adapted to be selectively engagable or disengagable for securing or releasing said fastener portion, respectively. One of said fastener portions is secured to the inside of said glove and the other of said fastener portions is adapted to be secured to said ornamental accessory. In this way any selected one of a plurality of ornamental accessories provided with said other of said fastener portions is adapted to be releasably secured to the glove to form a glove and accessory combination which simulates a glove having an accessory permanently secured thereto by stitching.

9 Claims, 3 Drawing Sheets

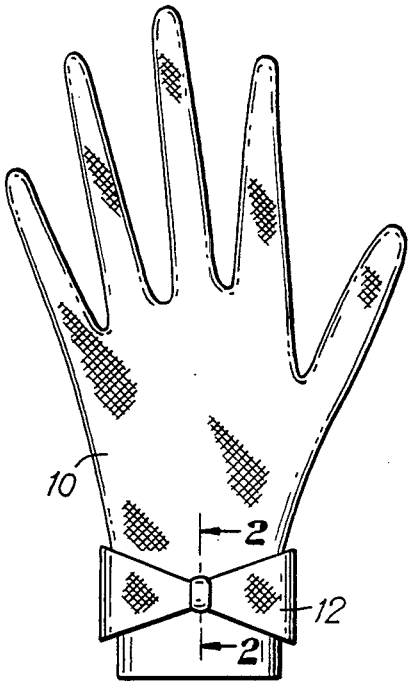
FIG. 1
PRIOR ART
FIG. 2
PRIOR ART
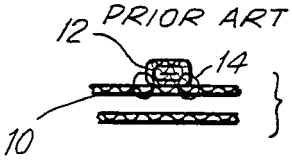
FIG. 3
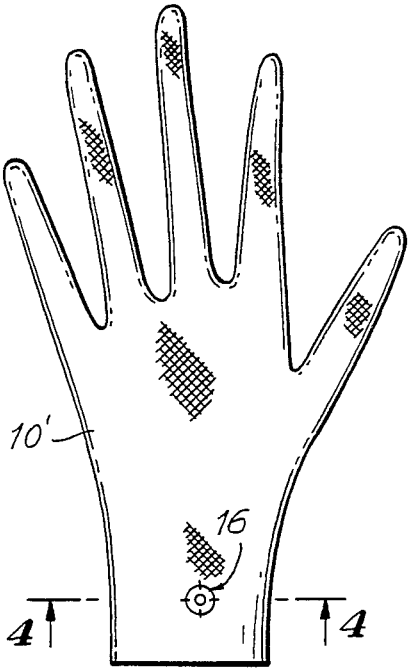
FIG. 4
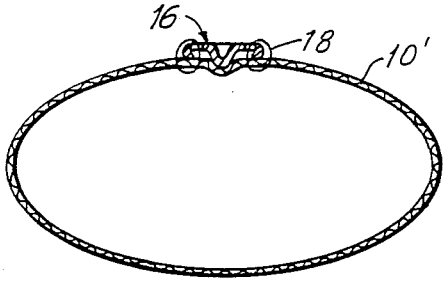

FIG. 10
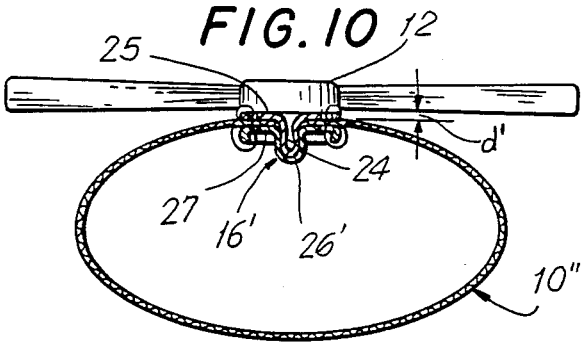
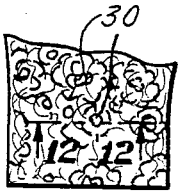
FIG. 11
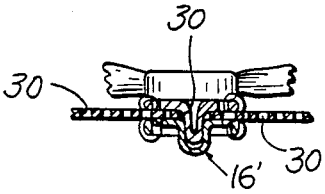
FIG. 12
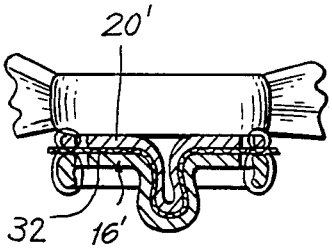
FIG. 13

GLOVE CONSTRUCTION WITH MEANS FOR REMOVABLY SECURING ACCESSORIES

BACKGROUND AND BRIEF DESCRIPTION OF THE INVENTION

Women's gloves are often provided with ornamental elements or accessories such as bows, flowers, which cooperate with and complement the rest of the glove in order to impart an overall attractive look for the wearer.

An example of a glove provided with an ornamental element, such as a bow, is shown in my prior U.S. Pat. No. 4,757,558. In this patent, however, the ornamental element becomes a permanent part of the glove so that the wearer is compelled, if she decides to wear a particular pair of gloves, to include the particular ornamental accessory which is a permanent part of the glove even though this may not match the rest of the wearer's apparel.

It is therefore a principal object of the invention to provide a fashion glove which is adapted to receive any one of a plurality of ornamental elements but which looks as if the accessory is permanently stitched onto the glove. In accordance with one embodiment of the invention, the glove and the decorative element are provided with complementary fastening elements which are releasable so that the decorative element is removably secured to the glove. In accordance with such preferred embodiment, the fastener combination which is used is a conventional snap fastener comprising cooperating male and female snap portions. One of these snap portions is secured onto the glove, while the other snap portion is secured to the decorative element. The decorative element is easily secured onto the glove by the cooperating snapping action of the respective male and female snap portions.

While the use of cooperating male and female snap portions on the glove and the decorative element, respectively, permits the use of a plurality of decorative elements with a single pair of gloves, there are also some negative effects due to the metal to metal or plastic to plastic contact between male and female snap portions which impart to the decorative element a tendency to rotate about the glove and therefore assume unattractive and undesirable positions relative to the glove. For example, in the case of a bow, it is obviously intended that the bow extend laterally of the wearer's hand and not longitudinally thereof. With the use of conventional male and female snap portions, on the ornamental element and the glove respectively, the snap portions are in physical engagement with each other resulting in metal to metal contact wherein the snap portion on the glove provides, in effect, a bearing for the snap portion on the ornamental element, creating the aforementioned tendency of the ornamental element to rotate in response to the slightest movement of the hand or in response to the inadvertent contact of the ornamental element with another object.

It is important to note that the object to be achieved is the duplication, to the extent possible, of the appearance of a glove to which an ornamental element has been permanently fastened, as by stitching. This visual impression is not possible with the conventional use of male and female snap portions wherein the snap portions are sewed on the outer surfaces of the glove and decorative elements, respectively, causing the ornamental element to be spaced from the glove by the combined thicknesses of the engaged male and female snap portions. This results in an aesthetically unacceptable arrangement with the ornamental element being raised substantially above the surface of the glove proper.

The duplication of the appearance of a permanently attached ornamental accessory to the glove requires the use of an accessory which appears to be firmly attached onto the glove, without any spacing between the accessory and the glove, and also requires that the ornamental element does not tilt or swing out of position. The use of snap fastener elements, in the conventional manner, as pointed out above, does not produce an arrangement which visually duplicates the desired look of a permanently attached accessory onto the glove.

The securing of an accessory to a glove is crucial to its appearance. Highly skilled sewing machine operators on special type machines, or highly skilled hand sewers are required to do the tedious work of securing the ornamental accessory onto the glove properly.

Thus the primary object of the invention is to provide means for permitting the use of any selected one of a plurality of ornamental accessories with a single glove, by using a snap fastener arrangement, but without the accompanying drawbacks of having the ornamental element spaced a significant amount from the surface of the glove proper, and with a tendency to pivot about the snap at the slightest provocation.

In accordance with the invention, the snap fastener portion provided on the glove is the female snap portion which is secured to the inner side of the glove rather than to the outer side thereof and the complementary male snap portion is stitched onto the ornamental element. Thus, when the glove is worn without any accessory the snap portion on the glove is inside the glove and hardly visible. The glove is provided with a slit which confronts the cavity of the female snap portion so that the projection of the male snap fastener portion can be inserted into the female snap portion cavity in order to snap therein and complete the fastening operation. The edges of the slit are preferably finished off as in a button hole, in order to prevent any unraveling of the material of the glove. When the ornamental element, which is provided with the male snap portion, is snapped into the female snap portion on the inside of the glove, with the projection passing through the slit and engaging the cavity, the glove material is trapped between the confronting surfaces of the respective snap elements to avoid a metal to metal contact between these two surfaces and thus provide friction between the two snap portions to minimize the tendency of one to rotate with respect to the other. In addition, because the female snap fastener element is secured to the inner side of the glove the ornamental element is not spaced from the glove by an amount equal to the thickness of the female snap portion. Since the female snap portion of a snap fastener arrangement is approximately three times the thickness of a male fastener element the result of the arrangement in accordance with the invention is to create the appearance of having the ornamental element secured, as by stitching, directly onto the glove, while at the same time having the capacity to be interchangeably used wit different ornamental elements or accessories.

Where the glove fabric is provided with natural holes or openings, as is the case with lace, no slits are necessary since the projecting element of the male snap fastener portion can easily be snapped into the female cavity by passing through one of the natural openings in the fabric and all the advantages of this arrangement are preserved.

Where the glove fabric is very sheer, no slit is necessary, as a proper snap fastener element can be selected in which the male and female snap portions can be snapped together with the sheer material captive therebetween. In this arrangement, again, the ornamental element is constrained from pivotal movement by the friction between the captive material and the confronting surfaces, and the ornamental element also appears to be close to the surface of the glove, as is the case in a permanently secured ornamental element.

The above and other objects, features and advantages of the present invention will become readily apparent from the following detailed description which is to be read in conjunction with the accompanying drawings.

BRIEF DESCRIPTION OF THE DRAWINGS

FIG. 1 is a top plan view of a glove provided with an ornamental accessory, in accordance with the prior art;

FIG. 2 is a sectional view taken along line 2—2 of FIG. 1;

FIG. 3 is a top plan view of a glove provided on its outer surface with a female snap portion, for receiving any one of a plurality of decorative elements;

FIG. 4 is a sectional view taken along lines 4—4 of FIG. 3;

FIG. 10 is a view illustrating the glove of FIG. 8 with the ornamental accessory of FIGS. 4 & 5 secured thereto;

FIG. 11 is a fragmented plan view showing lace material out of which a glove can be made;

FIG. 12 is a view similar to FIG. 10 but showing a glove made of lace and provided with natural openings therein; and FIG. 13 is a view similar to FIG. 12 and FIG. 10 illustrating a glove made of very sheer material to which a decorative accessory has been secured.

DETAILED DESCRIPTION OF THE PREFERRED EMBODIMENTS

Figure 5:
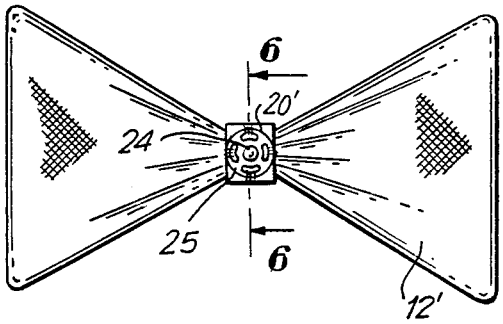
FIG. 5 is an ornamental accessory provided with a male snap portion for engagement with a female snap portion on the glove in FIGS. 3 and 4.

Referring now to the drawings, and particularly FIGS. 1 and 2 thereof, there is shown a conventional glove 10 provided with an ornamental accessory 12, which is shown typically as a bow, permanently secured to glove 10, by means of stitching 14 as shown in FIG. 2. As seen in FIG. 2, the accessory 12 is retained in permanent engagement with the glove, as desired for esthetic purposes, and the said accessory, because of the permanent stitching 14, will be substantially prevented from being rotationally or otherwise displaced from its intended orientation, namely transverse to the longitudinal direction of the glove.

It will be appreciated that while the glove of FIG. 1 is ideal in terms of maintaining the accessory in a secured desired position, the glove is not usable with any other accessory and thus has limited utilization.

Referring now to FIGS. 3 through 7 there is shown a glove 10' provided on the outer surface of the palm side thereof with female snap portion 16 which, as shown in FIG. 4, is secured to the outside of the glove by conventional stitching 18.

Figure 6:
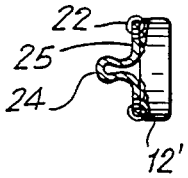
FIG. 6 is a sectional view taken along line 66 of FIG. 5.
Figure 7:
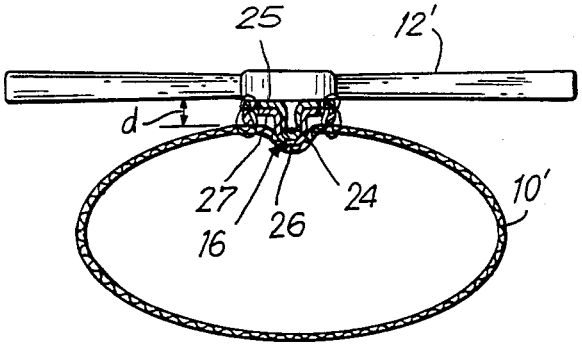
FIG. 7 is a view, partially in section illustrating the decorative accessory of FIGS. 5 and 6 secured to the glove of FIGS. 3 and 4.

Glove 10' is intended to be used in conjunction with ornamental element or accessory 12', best illustrated in FIGS. 5 and 6. Ornamental accessory 12', illustratively shown as a bow, is provided at its center knot with male snap portion 20' secured thereto by stitching 22. Male snap portion 20' is provided with a projecting member 24, adapted to be snapped into the cavity 26 of the complementary female snap portion 16 as shown in FIG. 7 wherein the decorative element 12' is secured to glove 10' by the interconnection of projecting member 24 of the male snap portion with the cavity 26 of the female snap portion. It will be noted, particularly with reference to FIG. 7 that the accessory 12' is spaced from the glove 10' a significant distance "d" which is unattractive and which clearly indicates that the accessory, namely the bow, is not permanently secured by stitching to the glove, the impression intended to be created.

Furthermore it will be noted, assuming the use of metallic snap fastener elements, male and female, that there is metal to metal engagement between the annular member 25 bounding projection 24 of the male snap portion and annular member 27 bounding cavity 26 of the female snap portion when the two are secured to each other, as shown in FIG. 7. Such metal to metal contact minimizes the amount of friction between the two fastening elements portions whereby the bow is easily displaced from its intended transverse position to one which is clearly undesirable and unsuitable for the wearer.

Thus, while the embodiment of FIG. 3 through 7 permits the free interchange of ornamental accessories with the same pair of gloves, the resulting combination leaves much to be desired, in that such combination is one in which the accessory is spaced from the glove proper a distance too great to be acceptable, and in that the accessory is easily displaced or assumes an unintended orientation. Thus the embodiment of FIGS. 3 through 7 fails to duplicate the intended impression that the decorative accessory is firmly secured to the glove as by stitching to the glove.

Figure 8:
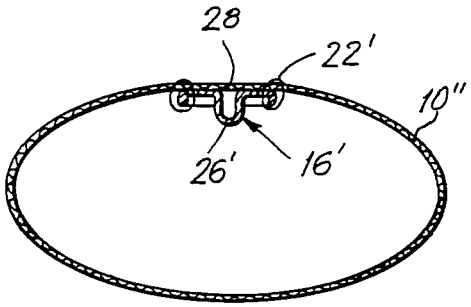
FIG. 8 is a sectional view of a glove in accordance with the preferred embodiment of the invention.
Figure 9:
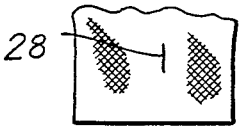
FIG. 9 is a partial top plan view of FIG. 8.

Referring now to FIGS. 8 and 9 there is shown the preferred embodiment in accordance with the invention. As shown in FIG. 8, glove 10'' is provided with female snap portion 16' which, unlike the embodiment of FIG. 4, is secured to the inside of the glove 10'' by means of stitching 22'. Further, as shown in FIG. 9, a short slit 28 is provided in the glove immediately confronting the cavity 26' of the female snap portion 16'. The glove of FIG. 8 is now able to receive, in snapping engagement, the accessory 12' of FIG. 5 as shown in FIG. 10 by the engagement of male projection 24 into the cavity 26', with the male projecting element passing through the glove fabric via slit 28. If desired, the male snap portion could be secured to the inside of glove 10'' and the female snap portion to the ornamental accessory. This would, however, yield a less satisfactory arrangement as the male projection would extend through the slit and be exposed when no accessory is attached to the glove.

With further reference to FIG. 10, it will be seen that the resulting combination of accessory and glove is one wherein the accessory is nearly in contact with the glove itself because the major width of the snap fastener, namely the female snap portion 16', is located inside the glove and does not contribute to the spacing between the accessory 12' and the glove 10'' itself, thus providing an appearance which simulates that of an ornamental element directly stitched onto the glove.

It will further be noticed that the material of the glove proper is captive between annular members 25 and 27 of the male and female snap portions, respectively, to eliminate metal to metal contact between the two. This provides for substantially increased friction between the male and female snap portions to, in turn, substantially minimize, if not entirely eliminate, the tendency of the ornamental element to be displaced from its intended position. In connection with this embodiment, it should be noted that in a conventional snap fastening element the width of the female snap element is nearly three times that of the male snap portion, so that "d'" in FIG. 10 is approximately one quarter of "d" in FIG. 7.

Accordingly, the feature of the present invention which comprises the securing of the female snap portion inside the glove, and under the glove fabric, provides the substantial advantage of permitting easy substitution of accessories while still retaining the impression of an accessory which is directly stitched onto the glove.

Referring now to FIG. 11 there is shown a small section of lace fabric which is often utilized as the material for the glove or for part of the glove. Such lace is provided with natural openings such as shown by numeral 30. Where a glove is provided with lace having such natural openings, it becomes unnecessary to provide a slit for the passage of the projecting member on the male snap portion since such projecting member can easily pass through one of the natural openings in the lace fabric. This is shown in FIG. 12, which is similar to FIG. 10 except only that the projecting element on the accessory passes through natural opening 30 in the glove fabric. In all other respects the embodiment of FIGS. 11 and 12 is the same as that of FIG. 10 wherein the accessory, once secured to the glove proper, is in very close proximity to the glove surface and is prevented from inadvertent rotation with respect thereto, to most satisfactorily simulate a glove having an ornamental accessory secured directly onto the glove.

FIG. 13 is a view similar to FIGS. 10 and 12 but illustrates the application of the invention where the glove is made of material 32 which is very thin or very sheer. In such eventuality, there is no natural opening nor is there any need to provide a slit in the fabric because the sheerness of the fabric makes it possible for it to be trapped in between the male and female snap portions 20' and to secure the ornamental accessory to the glove in substantially the same manner as shown in FIG. 12 and FIG. 10, without perforating the glove.

Having described the preferred embodiments of the invention with reference to the accompanying drawings, it will be appreciated that the present invention is not limited to those precise embodiments, and that various changes and modifications may be effected therein by one of ordinary skill in the art without departing from the scope or spirit of the invention as defined in the appended claims.

What is claimed is:

1. A glove adapted to have releasably secured thereto an ornamental accessory comprising, (a) fastener means having a pair of complementary fastener portions adapted to be selectively engagable or disengagable for securing or releasing said fastener portions, respectively, (b) one of said fastener portions being secured to the inside of said glove and the other of said fastener portions being adapted to be secured to said ornamental accessory, (c) whereby any selected one of a plurality of ornamental accessories provided with said other of said fastener portions is adapted to be releasably secured to the glove to form a glove and accessory combination which simulates a glove having an accessory permanently secured thereto by stitching.

2. A glove in accordance with claim 1 wherein said fastener means comprise a snap fastener element having a male and a female portion with said male portion having a projection and said female portion having a cavity adapted to receive said projection for securing said male and female portion.

3. A glove in accordance with claim 2, wherein said female portion defines said one fastener portion secured to said glove and said male portion defines said other fastener portion adapted to be secured to said ornamental accessory.

4. A glove in accordance with claim 1 wherein said fastener means comprise a snap fastener element having a male and a female portion with said male portion having a projection bounded by an annular member and said female portion having a cavity bounded by an annular member, said cavity being adapted to receive said projection for securing said male and female portion.

5. A glove in accordance with claim 4 wherein said female portion defines said one fastener portion secured to said glove and said male portion defines said other fastener portion adapted to be secured to said ornamental accessory.

6. A glove in accordance with claim 5 wherein said female portion of the fastener means is secured to the inside of the glove with the annular member in engagement with the glove material whereby said female portion is substantially concealed from view when the glove is worn without ornamental accessory.

7. A glove in accordance with claim 6 wherein the glove is provided with a slit immediately confronting the cavity of the female fastener portion to permit passage of the projection on the male fastener portion for engagement in said cavity, said glove material being captured between said annular members to inhibit relative rotation between said annular member.

8. A glove in accordance with claim 6, wherein said glove material includes natural holes and said female portion is secured to the inside of the glove with one of said natural holes immediately corporating the cavity in said female fastener portion to permit passage of the projection of the male fastener portion for engagement in said cavity.

9. A glove in accordance with claim 8, wherein said glove material includes lace fabric having said natural holes.

* * * * *